US009567880B2

(12) United States Patent
Shieh et al.

(10) Patent No.: US 9,567,880 B2
(45) Date of Patent: Feb. 14, 2017

(54) OIL PAN ASSEMBLY

(71) Applicant: Toyota Motor Engineering & Manufacturing North America, Inc., Erlanger, KY (US)

(72) Inventors: Tenghua Tom Shieh, Ann Arbor, MI (US); Bogdan Radu Kucinschi, Ann Arbor, MI (US); Dong-Hyun Lee, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 120 days.

(21) Appl. No.: 14/697,915

(22) Filed: Apr. 28, 2015

(65) Prior Publication Data

US 2016/0319714 A1 Nov. 3, 2016

(51) Int. Cl.
*F01M 11/04* (2006.01)
*F01M 11/00* (2006.01)

(52) U.S. Cl.
CPC .. *F01M 11/0004* (2013.01); *F01M 2011/0033* (2013.01)

(58) Field of Classification Search
CPC ..... F01M 11/004; F01M 11/0033; F01M 11/0066; F01M 11/02; F01M 2011/023
See application file for complete search history.

(56) References Cited

U.S. PATENT DOCUMENTS

| | | | | |
|---|---|---|---|---|
| 2,938,601 | A | 5/1960 | Brafford | |
| 3,425,514 | A | 2/1969 | Shier | |
| 3,688,871 | A * | 9/1972 | Krestan | F01M 11/0004 184/106 |
| 4,770,276 | A | 9/1988 | Takubo | |
| 4,848,293 | A | 7/1989 | Sasada et al. | |
| 5,038,890 | A | 8/1991 | Tanaka et al. | |
| 5,058,545 | A | 10/1991 | Hirai et al. | |
| 5,103,782 | A | 4/1992 | Matsui | |
| 5,136,993 | A | 8/1992 | Ampferer et al. | |
| 5,158,053 | A | 10/1992 | Krechberger et al. | |
| 5,465,692 | A | 11/1995 | Uraki et al. | |
| 6,340,012 | B1 | 1/2002 | Yamashita et al. | |
| 6,796,283 | B1 | 9/2004 | Fleury et al. | |
| 6,845,743 | B1 | 1/2005 | Bishop | |
| 8,069,834 | B2 | 12/2011 | Riedel et al. | |
| 8,578,906 | B2 | 11/2013 | Yamada et al. | |
| 2004/0177827 | A1 | 9/2004 | Hoyte et al. | |
| 2011/0073062 | A1 | 3/2011 | Nakashima et al. | |

FOREIGN PATENT DOCUMENTS

JP WO 2012073725 A1 * 6/2012 ..... F01M 11/02

* cited by examiner

*Primary Examiner* — Lindsay Low
*Assistant Examiner* — Kevin Lathers
(74) *Attorney, Agent, or Firm* — Dinsmore & Shohl LLP

(57) ABSTRACT

An oil pan assembly and an engine assembly having a vortex generating unit configured to de-aerate entrained oil before reaching the intake pipe is provided. The oil pan assembly includes an inner plate mounted to the oil pan so as to be disposed between the oil pan and a bottom surface of the engine block. The vortex generating unit is disposed on the inner plate and generates a vortex which de-aerates entrained oil.

16 Claims, 5 Drawing Sheets

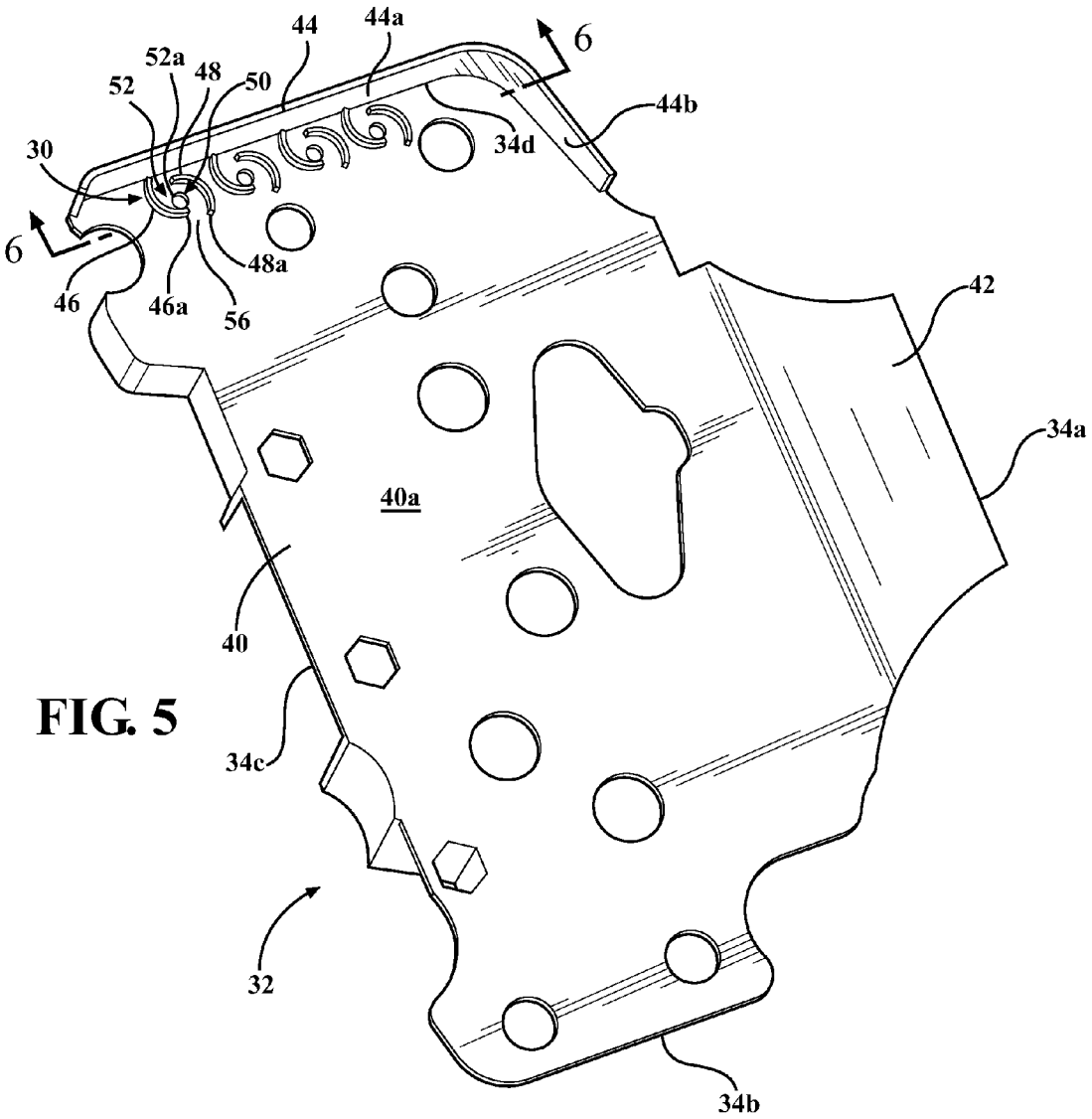
FIG. 5
FIG. 6
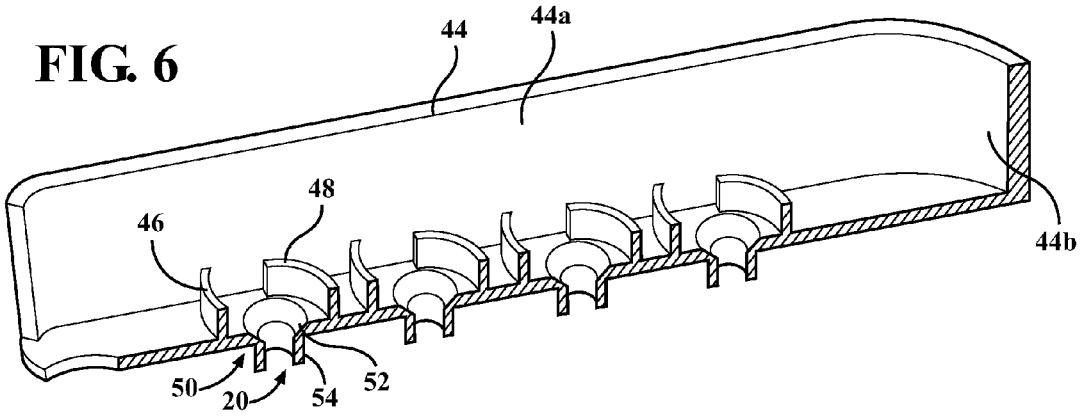

OIL PAN ASSEMBLY

FIELD OF THE INVENTION

An oil pan assembly configured to generate a vortex so as to de-aerate entrained oil is provided.

BACKGROUND OF THE INVENTION

Oil pan assemblies are mounted to the bottom portion of an engine block and are used to capture oil distributed through the engine. An oil filter is attached to the oil pan assembly for removing particulates from the oil. The oil pan assembly may include an intake pipe. The intake pipe has an intake disposed adjacent the bottom of the oil pan.

A pump may also be attached to the intake pipe for recirculating the captured oil. The oil is directed throughout the engine. As oil is distributed throughout the engine, the oil is heated and subjected to force resulting from the operation of the engine. For instance, the operation of moving engine parts such as the chain, oil jet, and balancer aerates the oil. Thus, the oil is frothy and entrained when received and collected by the oil pan. As such, the pump may not effectively redistribute the entrained oil. Accordingly, it remains desirable to have an oil pan assembly wherein the entrained oil is de-aerated so as to achieve a liquid form optimal for distribution through the pump. For use herein, the term "de-aerated" refers to the process of removing air from the oil and the term "entrained" refers to a condition of the oil wherein air bubbles are introduced into the oil.

SUMMARY OF THE INVENTION

An oil pan assembly having a vortex generating unit configured to de-aerate entrained oil is provided. The oil pan assembly includes an oil pan mounted beneath the engine block. The oil pan assembly also includes an inner plate mounted to the oil pan so as to be disposed between the oil pan and a bottom surface of the engine block. The vortex generating unit is disposed on a top surface of the inner plate.

The vortex generating unit includes a first guide spaced apart from a second guide. A funnel is disposed between the spaced apart guides. The funnel includes a first mouth and a stem. The first mouth is conical. The first and second guides are generally arcuate ribs having generally the same length. The first and second guides have opposing ends which are offset from each other. Thus, oil hitting the outer surface of the first guide is directed into the second mouth and towards the inner surface of the second guide. The second guide directs the oil into the first mouth of the funnel at an angle so as to generate a vortex.

An engine assembly is also provided. The engine assembly includes an engine block. The engine block is tilted so as to direct oil towards the lower portion of the engine block. An oil pan assembly is mounted to the bottom of the engine block. The oil pan assembly is configured to collect oil coming off of the engine block.

The oil pan assembly includes a vortex generating unit configured to de-aerate entrained oil. The oil pan assembly includes an oil pan mounted beneath the engine block. The oil pan assembly also includes an inner plate mounted to the oil pan so as to be disposed between the oil pan and a bottom surface of the engine block. The vortex generating unit is disposed on a top surface of the inner plate.

The vortex generating unit includes a first guide spaced apart from a second guide. A funnel is disposed between the spaced apart guides. The funnel includes a first mouth and a stem. The first mouth is conical. The first and second guides are generally arcuate ribs having generally the same length. The first and second guides have opposing ends which are offset from each other so as to form a second mouth. Thus, oil hitting the outer surface of the first guide is directed towards the inner surface of the second guide. The second guide directs the oil into the first mouth of the funnel at an angle so as to generate a vortex.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

FIG. 5 is top down isolated view of the inner plate; and

FIG. 6 is a cross sectional view the inner plate taken along line 6-6.

DETAILED DESCRIPTION OF THE PREFERRED EMBODIMENTS

An oil pan assembly and an engine assembly configured to generate a vortex so as to de-aerate entrained oil before reaching the pump are provided. The oil pan assembly is attached to the bottom of an engine block of an engine assembly.

Figure 1:
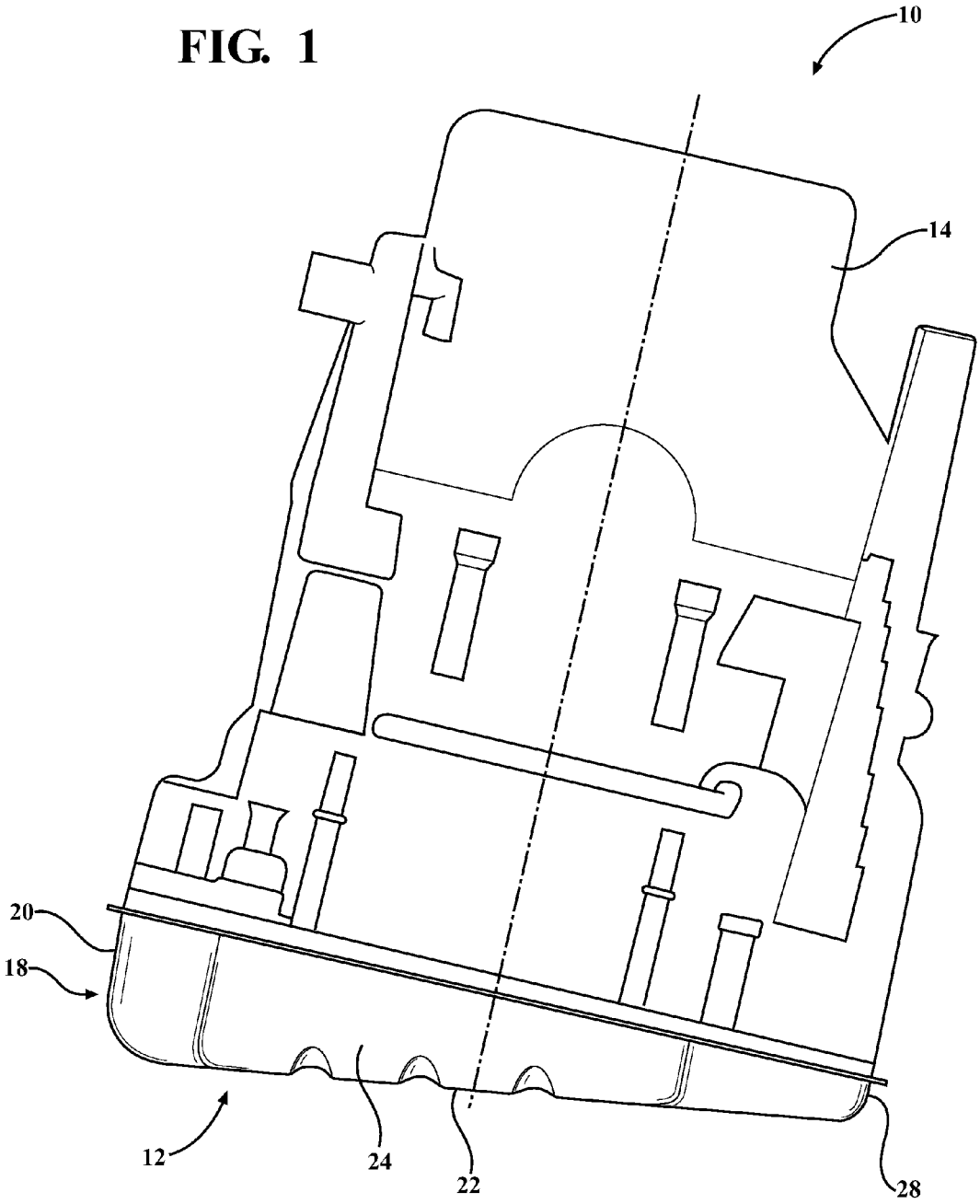
FIG. 1 is a perspective view taken from a front end of an engine block.

With reference now to FIG. 1 a front end view of the engine assembly 10 is provided. The engine assembly 10 includes an oil pan assembly 12 and an engine block 14. As shown, the body of the engine block 14 may be angled. The oil pan assembly 12 is mounted to the bottom of the engine block 14. The oil pan assembly 12 is configured to collect entrained oil dripping from the engine block 14 and chain case (not shown).

Figure 2:
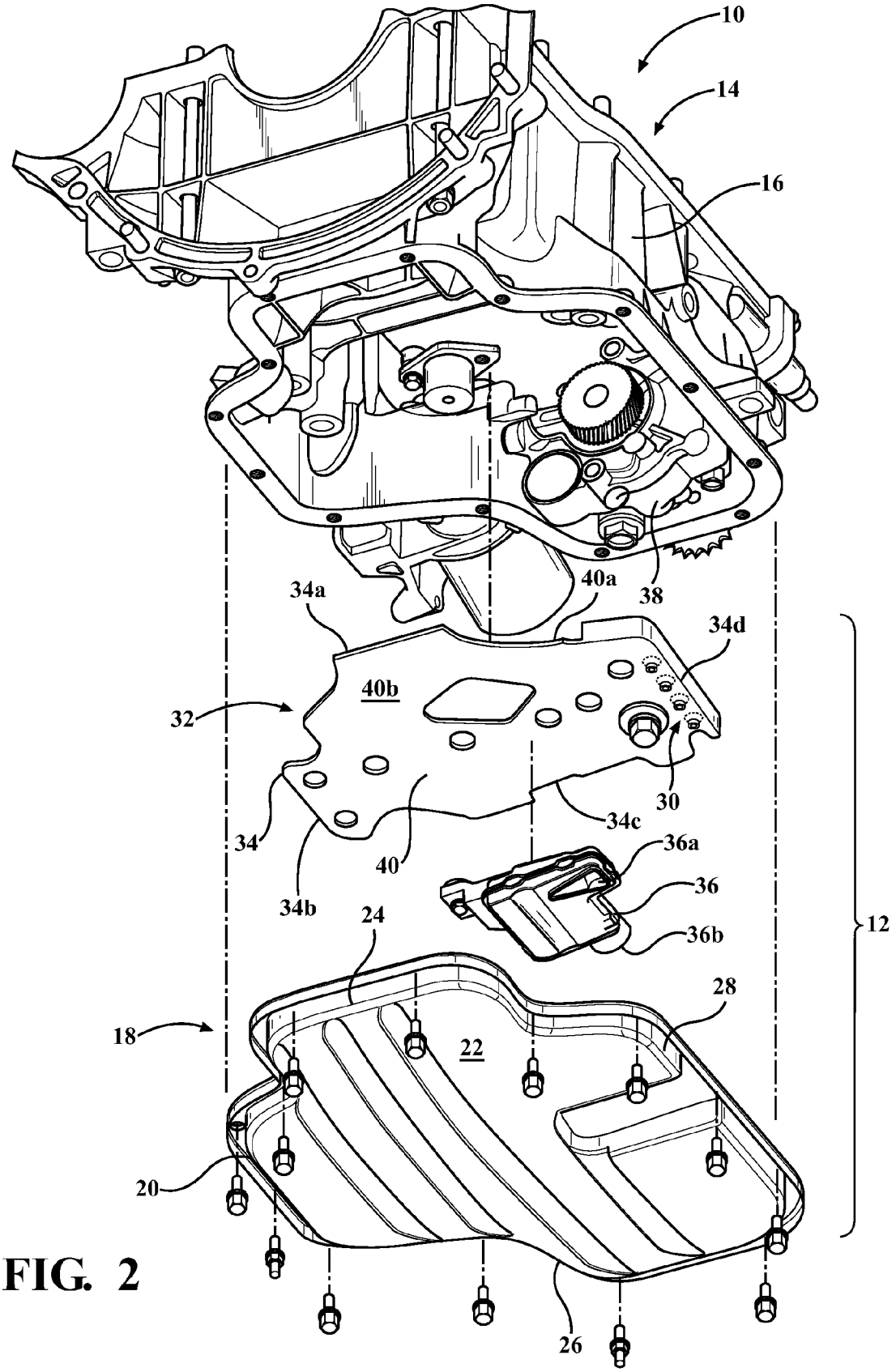
FIG. 2 is an exploded view of FIG. 1 showing the oil pan assembly, and the engine block assembly.

With reference now to FIG. 2, an exploded view of the engine assembly 10 is provided. The engine block 14 includes a casing 16. The casing 16 may be integrally formed to the bottom of the engine block 14. The casing 16 is a wall defining a chamber for which components may be housed. The casing 16 includes apertures for which the oil pan assembly 12 may be mounted to.

The oil pan assembly 12 includes an oil pan 18. The oil pan 18 is attached to the casing 16 and is disposed beneath the engine block 14. The oil pan 18 includes a first side wall 20 and a floor 22. The first side wall 20 is generally disposed on a vertical plane. The floor 22 is generally disposed along a horizontal plane. The oil pan 18 further includes a front wall 24 opposite a back wall 26 and a lip 28. The lip 28 is opposite the first side wall 20 and is shorter relative to the first side wall 20. The peripheral edge of the oil pan 18 include a plurality of through holes to allow for a fastening device such as a bolt to secure the oil pan 18 to the bottom of the engine block 14.

The oil pan assembly 12 includes a vortex generating unit 30 configured to de-aerate entrained oil. The vortex generating unit 30 is disposed on an inner plate 32. The inner plate 32 is disposed within the casing 16 and between the oil pan 18 and the engine block 14. The inner plate 32 is mounted to the oil pan 18. The inner plate 32 has a peripheral edge 34. The peripheral edge 34 includes a front edge portion 34*a*, an elevated side portion 34*b*, a back wall portion 34*c* and a lower side portion 34*d*.

An intake pipe 36 is disposed within the casing 16 and between the inner plate 32 and the floor 22 of the oil pan 18. The intake pipe 36 includes an opening 36*a* through which oil is drawn into. A pump 38 is mounted to an outlet 36*b* of the intake pipe 36. The pump 38 is configured to generate a vacuum pressure to draw collected oil and recycle the oil through the engine block 14.

The inner plate 32 has a first panel 40. The first panel 40 includes a plurality of through holes for which bolts and attachment features may pass through so as to attach the oil pan assembly 12 to the engine block 14. The first panel 40 includes a top surface 40*a* opposite a bottom surface 40*b*. The top surface 40*a* is opposite the bottom surface 40*b* of the engine block 14 and the bottom surface 40*b* of the first panel 40 is opposite the floor 22 of the oil pan 18.

Figure 3:
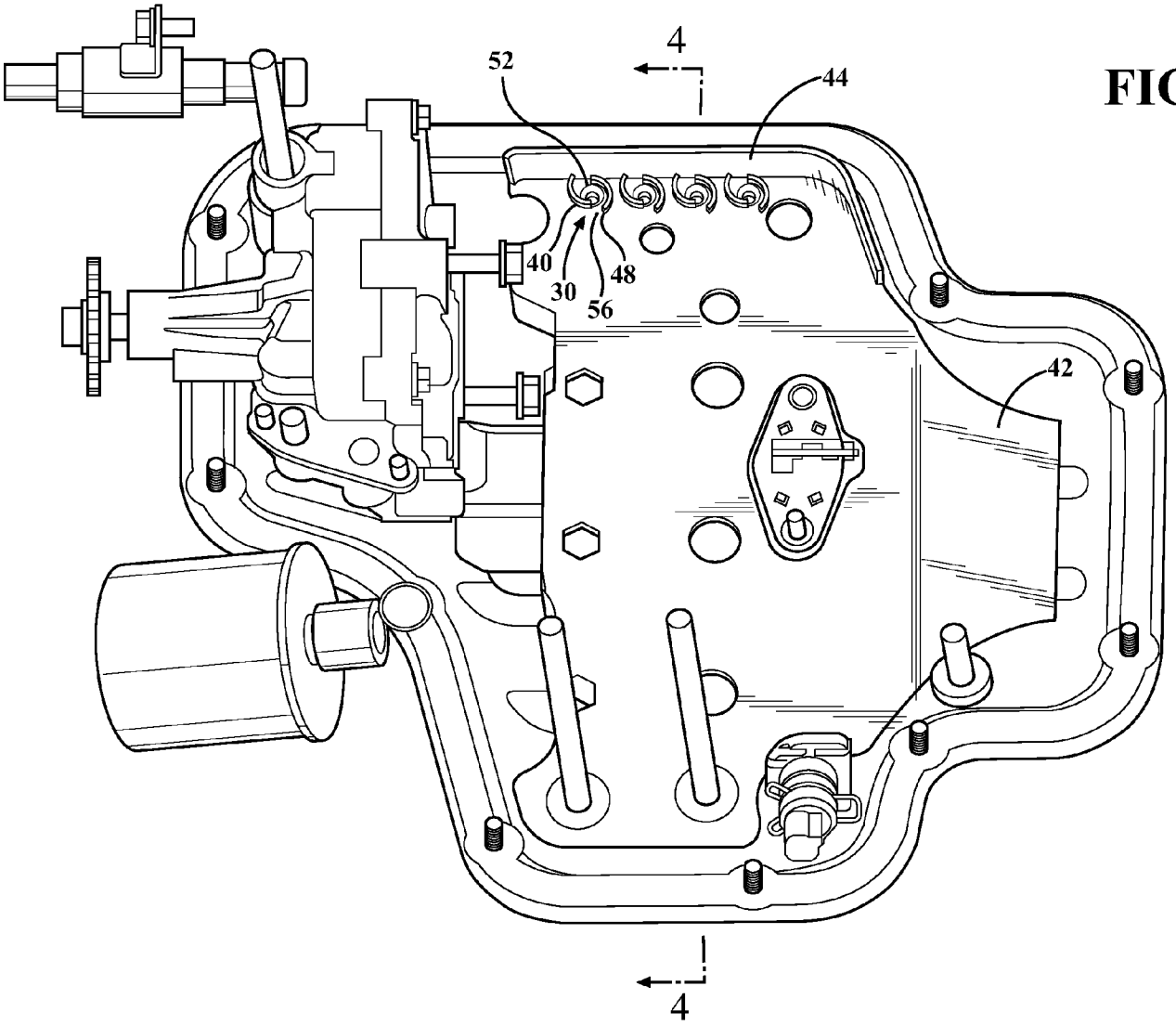
FIG. 3 is a top view of the oil pan assembly.
Figure 4:
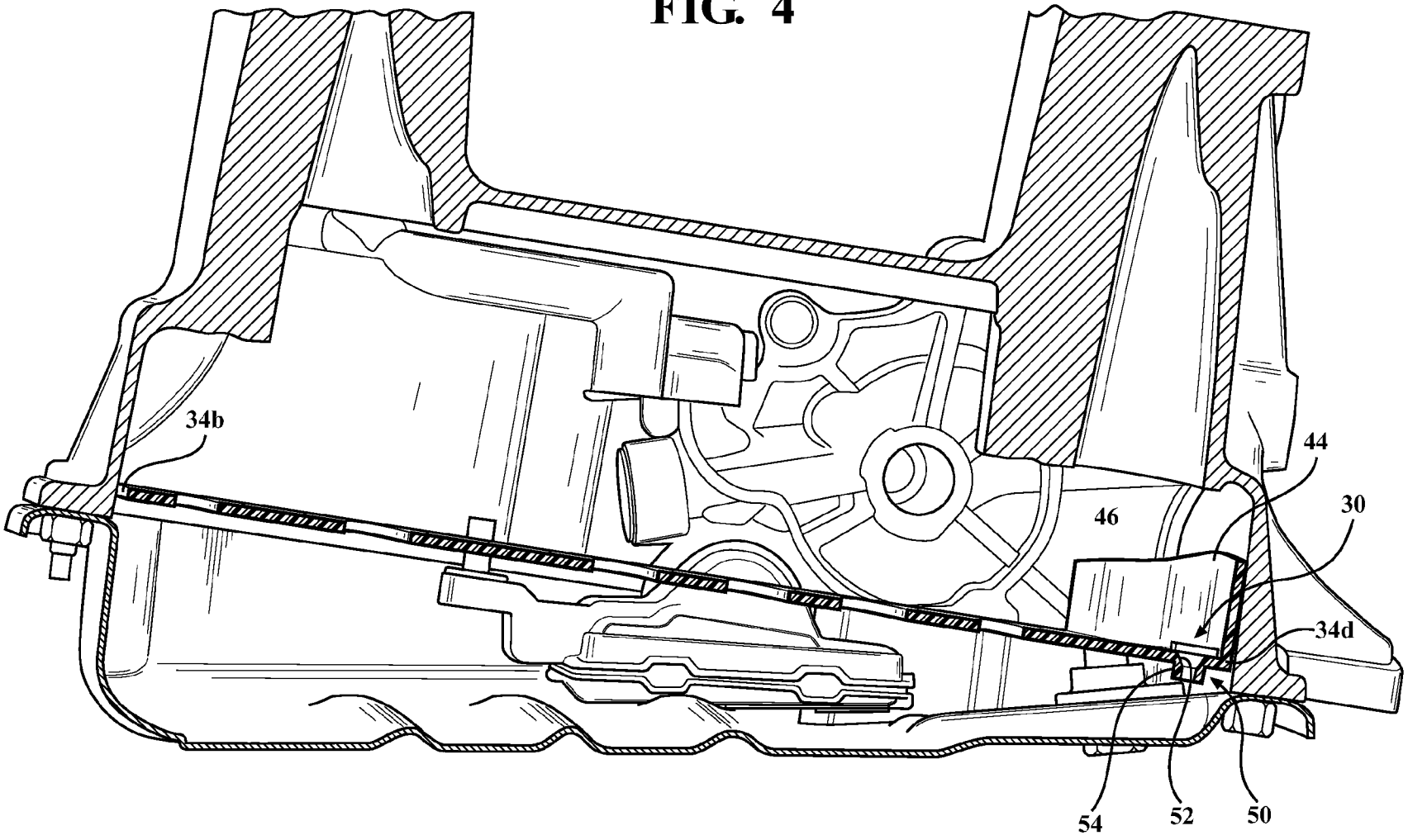
FIG. 4 is a cross sectional view of the engine assembly taken along line 4-4 is a view of the oil pane assembly shown in FIG. 3.

With reference now to FIGS. 3 and 4, the inner plate 32 is slanted so as to direct oil from elevated side portion 34*b* to the lower side portion 34*d*. The first panel 40 is disposed on a first plane. The first plane is angled with respect to the floor 22 and generally parallel to a bottom surface 40*b* of the engine block 14. The first panel 40 includes a ramp 42 that is contiguous with the first panel 40. The ramp 42 is disposed on a second plane that is angled with respect to the first panel 40. The ramp 42 is configured to direct captured oil towards a front wall 24 of the oil pan 18.

The inner plate 32 further may further include a top wall 44 disposed along a portion of a peripheral edge 34 of the top surface 40*a* of the first panel 40. Specifically, the top wall 44 is disposed along the lower side portion 34*d* of the peripheral edge 34 of the first panel 40 so as to catch oil draining from the elevated side portion 34*b*. The top wall 44 forms a catch preventing and slowing the flow of entrained oil to the intake pipe 36. The entrained oil is pooled along the top wall 44 and then spills over the exposed peripheral edge of the first panel 40 so as to allow the entrained oil additional time to de-aerate before reaching the intake pipe 36.

With reference again to FIGS. 3-4 and also 5 and 6, an illustrative view of the inner plate 32 showing the vortex generating unit 30 is provided. The vortex generating unit 30 includes a first guide 46 spaced apart from a second guide 48. A funnel 50 is disposed between the spaced apart guides. The funnel 50 includes a first mouth 52 and a stem 54. The first mouth 52 is generally conical in dimension.

The first and second guides 46, 48 are ribs projecting from the top surface 40*a* of the inner plate 32. The first and second guides 46, 48 are generally arcuate and generally the same length. The first guide 46 is convex with respect to the second guide 48 which is concave so as to generally form halves of a circle, wherein each half of the circle is non-concentric with respect to each other. Thus, the first end 46*a* of the first guide 46 is offset the first end 48*a* of the second guide 48 so as to form a second mouth 56. The second mouth 56 extends generally radially from the first end 46*a* of the first guide 46. The first end 46*a* of the first guide 46 touches the outer circumferential edge 56*a* of the second mouth 56 of the funnel 50.

The first end 46*a* of the first guide 46 may touch the outer circumferential edge of the funnel 50. Thus, oil hitting the outer surface of the first guide 46 is directed through the second mouth 56 towards the inner surface of the second guide 48. The second guide 48 directs the oil into the first mouth 52 of the funnel 50 at an angle so as to generate a vortex. As the entrained oil swirls along the first mouth 52, the entrained oil is de-aerated. Thus, air is separated from the oil and gravity directs the de-aerated oil into the stem 54, de-aerated oil collects along the inner surface of the stem 54 and drips in generally liquid form to the floor of the oil pan assembly 12 wherein the de-aerated oil is received by the intake pipe 36. FIGS. 3-6 show the inner plate 32 having four vortex generating units 30, each axially aligned with respect to each other. However, it should be appreciated that the oil pan assembly 12 or engine assembly 10 may contain more or less based upon the engine performance desired and packaging space. It should be appreciated that as the first panel 40 is slanted, oil dripping from the engine block 14 drains towards the vortex generating unit 30.

The top wall 44 includes a main top wall portion 44*a* and a side wall portion 44*b* forming a generally L-shaped profile which is easily seen in FIGS. 3 and 5. The top wall 44 is contiguous to a portion of the peripheral edge 34 of the first panel 40. The main top wall portion 44*a* runs along the lower side portion 34*d*. The side wall portion 44*b* extends generally orthogonal from an end of the main top wall portion 44*a* and runs along the front edge portion 34*c* of the peripheral edge 34 of the first panel 40. FIG. 3 shows, the main top wall portion 44*a* disposed on the lower side portion 34*d* of the peripheral edge 34 of the first panel 40. Thus, it should be appreciated that as oil drips onto the first panel 40 the oil via gravity slides along the first panel 40 towards the vortex generating units 30.

In operation, the oil pan assembly 12 is configured to generate a vortex so as to de-aerate entrained oil prior to being received by the intake pipe 36. The first panel 40 is slanted so as to direct oil into the vortex generating unit 30, wherein the entrained oil enters the second mouth 56 and is directed towards the inner surface of the second guide 48. The second guide 48 directs the oil into the first mouth 52 of the funnel 50 at an angle so as to generate a vortex. As the entrained oil swirls along the first mouth 52, de-aerated oil collects along the inner surface of the stem 54 and drips in generally liquid form to the floor of the oil pan assembly 12 wherein the de-aerated oil is received by the intake pipe 36.

With reference again to FIGS. 1, 2 and 3, an engine assembly 10 is provided. The engine assembly 10 includes an engine block 14 and an oil pan assembly 12. As shown, the body of the engine block 14 may be angled. The oil pan assembly 12 is mounted to the bottom of the engine block 14. The oil pan assembly 12 is configured to collect entrained oil dripping from the engine block 14.

With reference now to FIG. 2, an exploded view of the engine assembly 10 is provided. The engine block 14 includes a casing 16. The casing 16 may be integrally formed to the bottom of the engine block 14. The casing 16 is a wall defining a chamber for which components may be housed. The casing 16 includes apertures for which the oil pan assembly 12 may be mounted to.

The oil pan assembly 12 includes an oil pan 18. The oil pan 18 is attached to the casing 16 and is disposed beneath the engine block 14. The oil pan 18 includes a first side wall 20 and a floor 22. The first side wall 20 is generally disposed on a vertical plane. The floor 22 is generally disposed along a horizontal plane. The oil pan 18 further includes a front wall 24 opposite a back wall 26 and a lip 28. The lip 28 is opposite the first side wall 20 and is shorter relative to the first side wall 20. The peripheral edge of the oil pan 18 include a plurality of through holes to allow for a fastening device such as a bolt to secure the oil pan 18 to the bottom of the engine block 14.

The oil pan assembly 12 includes a vortex generating unit 30 configured to de-aerate entrained oil. The vortex generating unit 30 is disposed on an inner plate 32. The inner plate 32 is disposed within the casing 16 and between the oil pan 18 and the engine block 14. The inner plate 32 is mounted to the oil pan 18. The inner plate 32 has a peripheral edge 34. The peripheral edge 34 includes a front edge portion 34*a*, an elevated side portion 34*b*, a back wall portion 34*c* and a lower side portion 34*d*.

An intake pipe 36 is disposed within the casing 16 and between the inner plate 32 and the floor 22 of the oil pan 18. The intake pipe 36 includes an opening 34*a* for which oil is drawn into. A pump 38 is mounted to an outlet 36*b* of the intake pipe 36. The pump 38 is configured to generate a vacuum pressure to draw collected oil and recycle the oil through the engine block 14.

The inner plate 32 has a first panel 40. The first panel 40 includes a plurality of through holes to accommodate structure such as balance shaft cover bolts. The first panel 40 includes a top surface 40*a* opposite a bottom surface 40*b*. The top surface 40*a* is opposite the bottom surface 40*b* of the engine block 14 and the bottom surface 40*b* of the first panel 40 is opposite the floor 22 of the oil pan 18.

With reference now to FIGS. 3 and 4, the inner plate 32 is slanted so as to direct oil from elevated side portion 34*b* to the lower side portion 34*d*. The first panel 40 is disposed on a first plane. The first plane is angled with respect to the floor 22 and generally parallel to a bottom surface 40*b* of the engine block 14. The first panel 40 includes a ramp 42 that is contiguous with the first panel 40. The ramp 42 is disposed on a second plane that is angled with respect to the first plane. The ramp 42 is configured to direct captured oil towards a front wall 24 of the oil pan 18.

The inner plate 32 further may further include a top wall 44 disposed along a portion of a peripheral edge of the top surface 40*a* of the first panel 40. Specifically, the top wall 44 is disposed along the lower side portion 34*d* of the peripheral edge 34 of the first panel 40 so as to catch oil draining from the upper side edge. The top wall 44 forms a catch preventing and slowing the flow of entrained oil to the intake pipe 36. The entrained oil is pooled along the top wall 44 and then spills over the exposed peripheral edge of the first panel 40 so as to allow the entrained oil additional time to de-aerate before reaching the intake pipe 36.

With reference again to FIGS. 3-6, an illustrative view of the inner plate 32 showing the vortex generating unit 30 is provided. The vortex generating unit 30 includes a first guide 46 spaced apart from a second guide 48. A funnel 50 is disposed between the spaced apart guides. The funnel 50 includes a first mouth 52 and a stem 54. The first mouth 52 is generally conical in dimension.

The first and second guides 46, 48 are ribs projecting from the top surface 40*a* of the inner plate 32. The first and second guides 46, 48 are generally arcuate and generally the same length. The first guide 46 is convex with respect to the second guide 48 which is concave so as to generally form halves of a circle, wherein each half of the circle is non-concentric. Thus, the first end of the first guide 46 is offset the first end of the second guide 48 so as to place the second mouth 56 radially from the first end of the first guide 46. The first end 46*a* of the first guide 46 touches the outer circumferential edge 56*a* of the second mouth 56 of the funnel 50.

The first and second guides 46, 48 have opposing ends which are offset from each other so as to form a second mouth 56. The first end of the first guide 46 may touch the outer circumferential edge of the funnel 50. Thus, oil hitting the outer surface of the first guide 46 is directed through the second mouth 56 towards the inner surface of the second guide 48. The second guide 48 directs the oil into the first mouth 52 of the funnel 50 at an angle so as to generate a vortex. FIGS. 3-6 show the inner plate 32 having four vortex generating units 30, each axially aligned with respect to each other. However, it should be appreciated that the oil pan assembly 12 or engine assembly 10 may contain more or less based upon the engine performance desired and packaging space. It should be appreciated that as the first panel 40 is slanted, oil dripping from the engine block 14 drains towards the vortex generating unit 30.

The top wall 44 46 includes a main top wall portion 44*a* and a side wall portion 44*b* forming a generally L-shaped profile which is easily seen in FIGS. 3 and 5. The top wall 44 is contiguous to a portion of the peripheral edge 34 of the first panel 40. The main top wall portion 44*a* runs along the lower side portion 34*d*. The side wall portion 44*b* extends generally orthogonal from an end of the main top wall portion 44*a* and runs along the front edge portion 34*c* of the peripheral edge 34 of the first panel 40. FIG. 3 shows, the main top wall portion 44*a* disposed on the lower side portion 34*d* of the peripheral edge 34 of the first panel 40. Thus, it should be appreciated that as oil drips onto the first panel 40 the oil via gravity slides along the first panel 40 towards the vortex generating units 30.

In operation, the engine assembly 10 is configured to generate a vortex so as to de-aerate entrained oil prior to being received by the intake pipe 36. The first panel 40 is slanted so as to direct oil into the vortex generating unit 30, wherein the entrained oil enters the second mouth 56 and is directed towards the inner surface of the second guide 48. The second guide 48 directs the oil into the first mouth 52 of the funnel 50 at an angle so as to generate a vortex. As the entrained oil swirls along the first mouth 52, de-aerated oil collects along the inner surface of the stem 54 and drips in generally liquid form to the floor of the oil pan assembly 12 wherein the de-aerated oil is received by the intake pipe 36.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

The invention claimed is:

1. An oil pan assembly having an oil pan and an oil pump attached to a bottom of an engine block, the oil pan assembly comprising:

an inner plate mounted to the oil pan and disposed between the oil pan and the engine block, the inner plate having a first panel, the first panel having a top surface opposite a bottom surface, the first panel; and a vortex generating unit mounted to the first panel, the vortex generating unit configured to move entrained oil in a vortex so as to allow entrained oil to de-aerate before reaching the pump.

2. The oil pan assembly as set forth in claim 1, wherein the inner plate includes a peripheral edge, the vortex generating unit is disposed adjacent the peripheral edge.

3. The oil pan assembly as set forth in claim 1, wherein the vortex generating unit includes a first guide spaced apart from a second guide so as to form a second mouth, a funnel disposed between the first guide and the second guide, the first guide having a generally arcuate dimension, the second guide having a generally arcuate dimension, wherein the first guide is convex with respect to the second guide which is concave, wherein the first guide directs the entrained oil into an inner wall of the second guide, the second guide introducing the oil into the funnel at an angle so as to generate a vortex of entrained oil.

4. The oil pan assembly as set forth in claim 3, wherein the first and second guides are nonconcentric to the funnel, and wherein a first end of the first guide is offset a first end of the second guide so as to place the second mouth radially from the first end of the first guide.

5. The oil pan assembly as set forth in claim 3, wherein the funnel includes a first mouth and a stem, the first mouth is conical.

6. The oil pan assembly as set forth in claim 4, the vortex generating unit is a plurality of vortex generating units, each of the vortex generating units axially aligned with respect to each other.

7. The oil pan assembly as set forth in claim 4, further including a top wall, the top wall disposed along a portion of the peripheral edge of the top surface of the first panel.

8. The oil pan assembly as set forth in claim 4, wherein the first end of the first guide is touches an outer circumferential edge of the funnel.

9. An engine assembly having an engine block, wherein the engine block is tilted, an oil pan assembly mounted to a bottom of the engine block, the oil pan assembly having an oil pan, and a pump, the oil pan having a floor, the floor disposed along a generally horizontal plane, the oil pan assembly configured to catch oil, direct the oil to the pump wherein the pump returns the oil to the engine block, the engine assembly comprising:

an inner plate mounted to the oil pan and disposed between the oil pan and the engine block, the inner plate having a first panel, the first panel having a top surface opposite a bottom surface, the first panel disposed on a first plane, the first plane angled with respect to the floor of the oil pan, a ramp contiguous to the first surface and disposed on a second plane angled with respect to the first plane;

a vortex generating unit mounted to the first panel, the vortex generating unit configured to move entrained oil in a vortex so as to allow entrained oil to de-aerate before reaching the pump.

10. The engine assembly as set forth in claim 9, wherein the inner plate includes a peripheral edge, the vortex generating unit is disposed adjacent the peripheral edge.

11. The engine assembly as set forth in claim 9, wherein the vortex generating unit includes a first guide spaced apart from a second guide so as to form a second mouth, a funnel disposed between the first guide and the second guide, the first guide having a generally arcuate dimension, the second guide having a generally arcuate dimension, wherein the first guide is convex with respect to the second guide which is concave, wherein the first guide directs the entrained oil into an inner wall of the second guide, the second guide introducing the oil into the funnel at an angle so as to generate a vortex of entrained oil.

12. The engine assembly as set forth in claim 11, wherein the first and second guides are nonconcentric to the funnel, and wherein a first end of the first guide is offset a first end of the second guide so as to place the second mouth radially from the first end of the first guide.

13. The engine assembly as set forth in claim 11, wherein the funnel includes a first mouth and a stem, the first mouth is conical.

14. The engine assembly as set forth in claim 11, the vortex generating unit is a plurality of vortex generating units, each of the vortex generating units axially aligned with respect to each other.

15. The engine assembly as set forth in claim 11, further including a top wall, the top wall disposed along a portion of the peripheral edge of the top surface of the first panel.

16. The engine assembly as set forth in claim 11, wherein the first end of the first guide touches an outer circumferential edge of the funnel.

* * * * *